US012171389B2

(12) United States Patent
Freiherr Von Andrian-Werburg et al.

(10) Patent No.: US 12,171,389 B2
(45) Date of Patent: Dec. 24, 2024

(54) DISHWASHER

(71) Applicant: WHIRLPOOL CORPORATION, Benton Harbor, MI (US)

(72) Inventors: Matthias Emanuel Freiherr Von Andrian-Werburg, St. Joseph, MI (US); Veronica Marin Kramer, Wroclaw (PL); Miron Wawrzusiak, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/525,941

(22) Filed: Dec. 1, 2023

(65) Prior Publication Data

US 2024/0090738 A1 Mar. 21, 2024

Related U.S. Application Data

(62) Division of application No. 17/838,516, filed on Jun. 13, 2022, now Pat. No. 11,896,181.

(51) Int. Cl.

| | |
|---|---|
| ***A47L 15/00*** | (2006.01) |
| ***A47L 15/22*** | (2006.01) |
| ***A47L 15/42*** | (2006.01) |
| ***A47L 15/46*** | (2006.01) |

(52) U.S. Cl.

CPC ..... *A47L 15/0049* (2013.01); *A47L 15/0007* (2013.01); *A47L 15/22* (2013.01); *A47L 15/4225* (2013.01); *A47L 15/4293* (2013.01); *A47L 15/46* (2013.01); *A47L 2301/04* (2013.01); *A47L 2401/08* (2013.01); *A47L 2401/24* (2013.01); *A47L 2501/05* (2013.01); *A47L 2501/26* (2013.01); *A47L 2501/32* (2013.01); *A47L 2601/02* (2013.01)

(58) Field of Classification Search

CPC ..... A47L 15/00–508; A47L 2401/24; A47L 2401/08; B08B 3/00–14; D06F 2103/00–70; D06F 2105/00–62

See application file for complete search history.

(56) References Cited

U.S. PATENT DOCUMENTS

| | | | |
|---|---|---|---|
| 5,681,401 | A | 10/1997 | Gardner et al. |
| 8,192,551 | B2 | 6/2012 | Sundaram |
| 2007/0079851 | A1 | 4/2007 | Park et al. |

(Continued)

FOREIGN PATENT DOCUMENTS

| | | | |
|---|---|---|---|
| CN | 113693533 | A | 11/2021 |
| DE | 3732451 | A1 | 4/1989 |

(Continued)

OTHER PUBLICATIONS

European Search Report for Counterpart EP23179073.4, dated Oct. 30, 2023.

*Primary Examiner* — Natasha N Campbell
*Assistant Examiner* — Richard Z. Zhang
(74) *Attorney, Agent, or Firm* — McGarry Bair PC

(57) ABSTRACT

A dishwasher includes a tub at least partially defining a treating chamber, a rotatable spray arm comprising an outlet, and a liquid supply conduit fluidly coupled to the spray arm. A pump can be fluidly coupled to the liquid supply conduit and operated to flow liquid through an aperture in the liquid supply conduit and through the outlet in the rotatable spray arm.

11 Claims, 8 Drawing Sheets

(56) References Cited

U.S. PATENT DOCUMENTS

| | | | |
|---|---|---|---|
| 2018/0008117 | A1 | 1/2018 | Pleschinger et al. |
| 2021/0177236 | A1 | 6/2021 | Karazor |

FOREIGN PATENT DOCUMENTS

| | | | | |
|---|---|---|---|---|
| DE | 4418558 | A1 | | 11/1995 |
| DE | 102014205266 | A1 | | 9/2015 |
| EP | 0943281 | A2 | * | 9/1999 |
| EP | 3488756 | A1 | * | 5/2019 |
| WO | WO2015036040 | A1 | * | 3/2015 |
| WO | 2019120560 | A1 | | 6/2019 |

* cited by examiner

DISHWASHER

CROSS-REFERENCE TO RELATED APPLICATION(S)

This application is a divisional of U.S. patent application Ser. No. 17/838,516, filed Jun. 13, 2022, now U.S. Pat. No. 11,896,181, issued Feb. 13, 2024, which is incorporated by reference herein in its entirety.

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system can be provided for recirculating liquid throughout the tub to remove soils from the dishes. The spray system can include rotating or stationary sprayers. A user interface can be provided for selecting, modifying, or otherwise controlling a cycle of operation.

BRIEF DESCRIPTION

In one aspect, the disclosure relates to a dishwasher for treating dishes according to a cycle of operation. The dishwasher includes a tub at least partially defining a treating chamber; a rotatable spray arm having an outlet defining a rotational path as the rotatable spray arm is rotated; a liquid supply conduit fluidly coupled to the rotatable spray arm, the liquid supply conduit comprising an aperture confronting a portion of the rotational path; a pump fluidly coupled to the liquid supply conduit; and a sensor sensing a change in one of a voltage or a current drawn by the pump indicative of an impingement of liquid emitted from the outlet and the aperture.

In another aspect, the disclosure relates to a dishwasher for treating dishes according to a cycle of operation. The dishwasher includes a tub at least partially defining a treating chamber; a rotatable spray arm having an outlet; a liquid supply conduit fluidly coupled to the rotatable spray arm and having an aperture; and a pump fluidly coupled to the liquid supply conduit and configured to provide a pump signal comprising at least one of a pump motor voltage or a pump motor current; wherein, during rotation of the rotatable spray arm, the aperture of the liquid supply conduit defines a rotational path and emits a first spray, and the outlet of the rotatable spray arm emits a second spray toward the rotational path; and wherein the pump signal is indicative of impingement between the first spray and the second spray.

DETAILED DESCRIPTION

Figure 1:
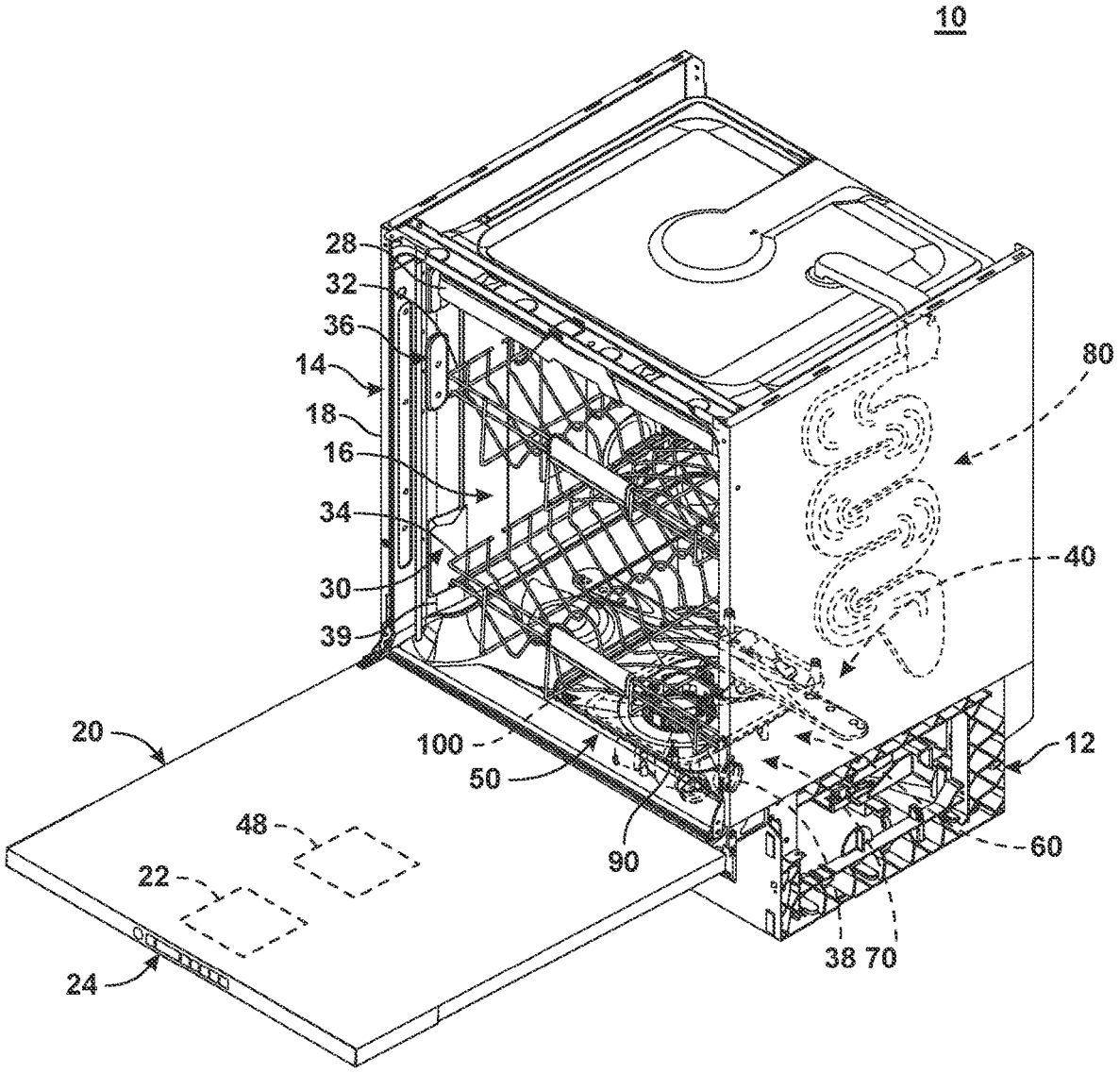
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" or "dish item(s)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
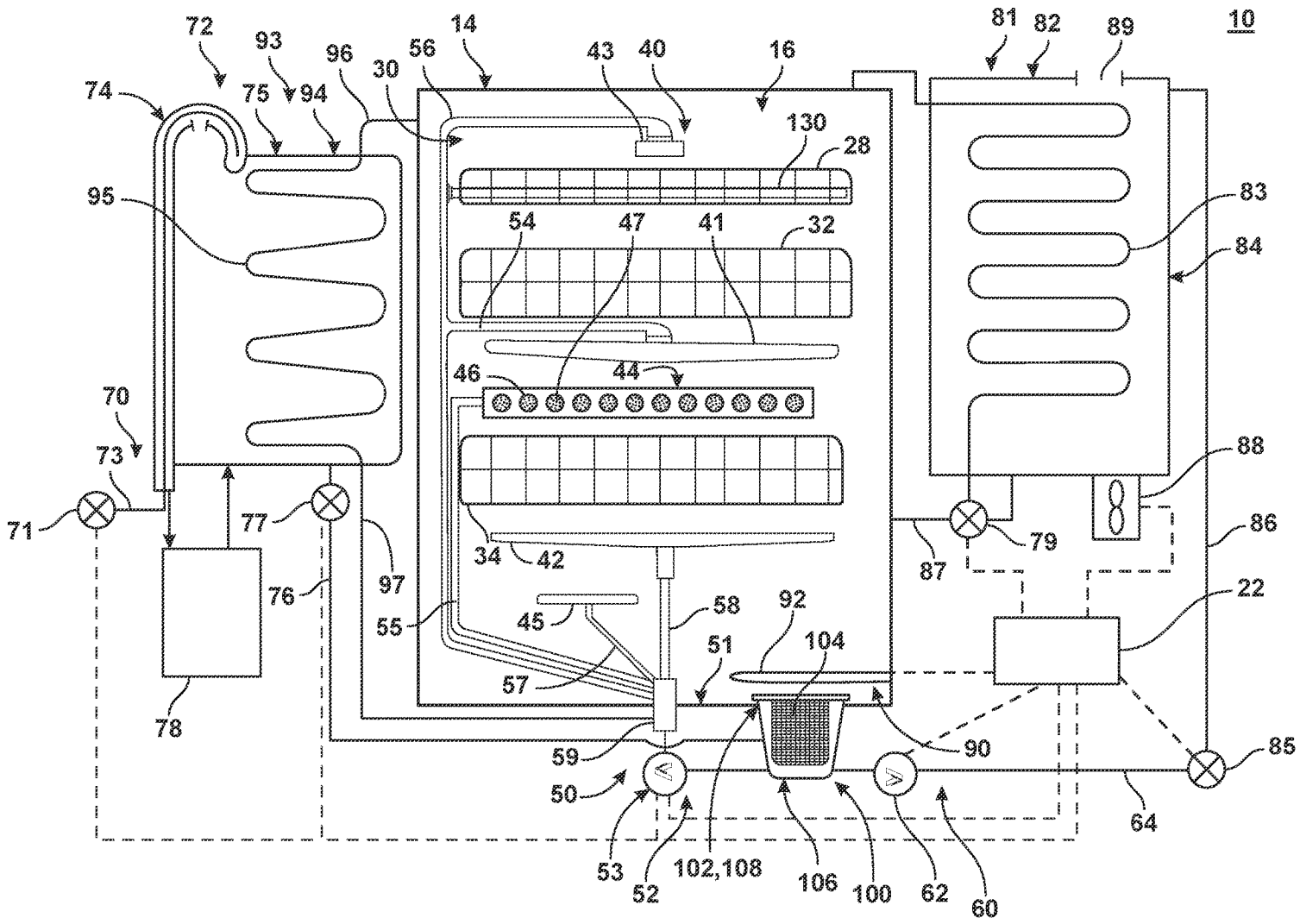
FIG. 2 is a schematic front view of the dishwasher of FIG. 1 illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple liquid supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
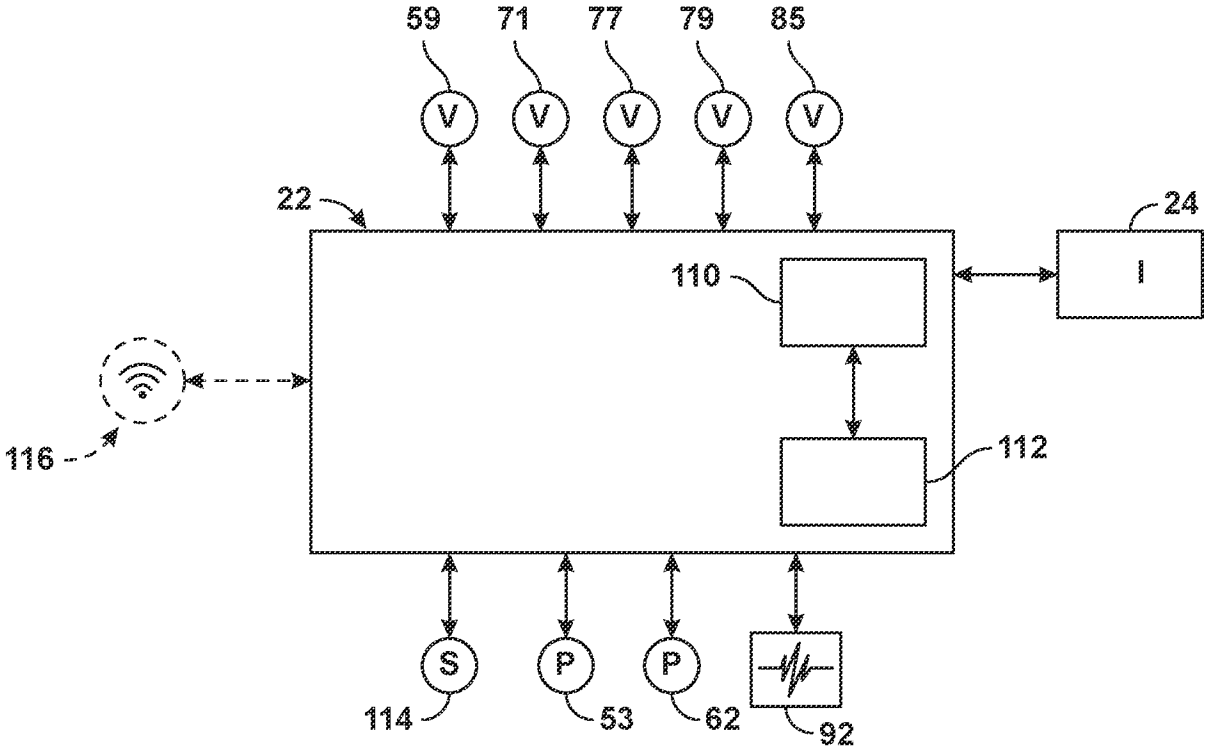
FIG. 3 is a schematic view of a controller of the dishwasher of FIG. 1.

As illustrated schematically in FIG. 3, the controller 22 can be coupled with the heater 92 for heating the wash liquid during a cycle of operation, the drain pump 62 for draining liquid from the treating chamber 16 (FIG. 2), and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
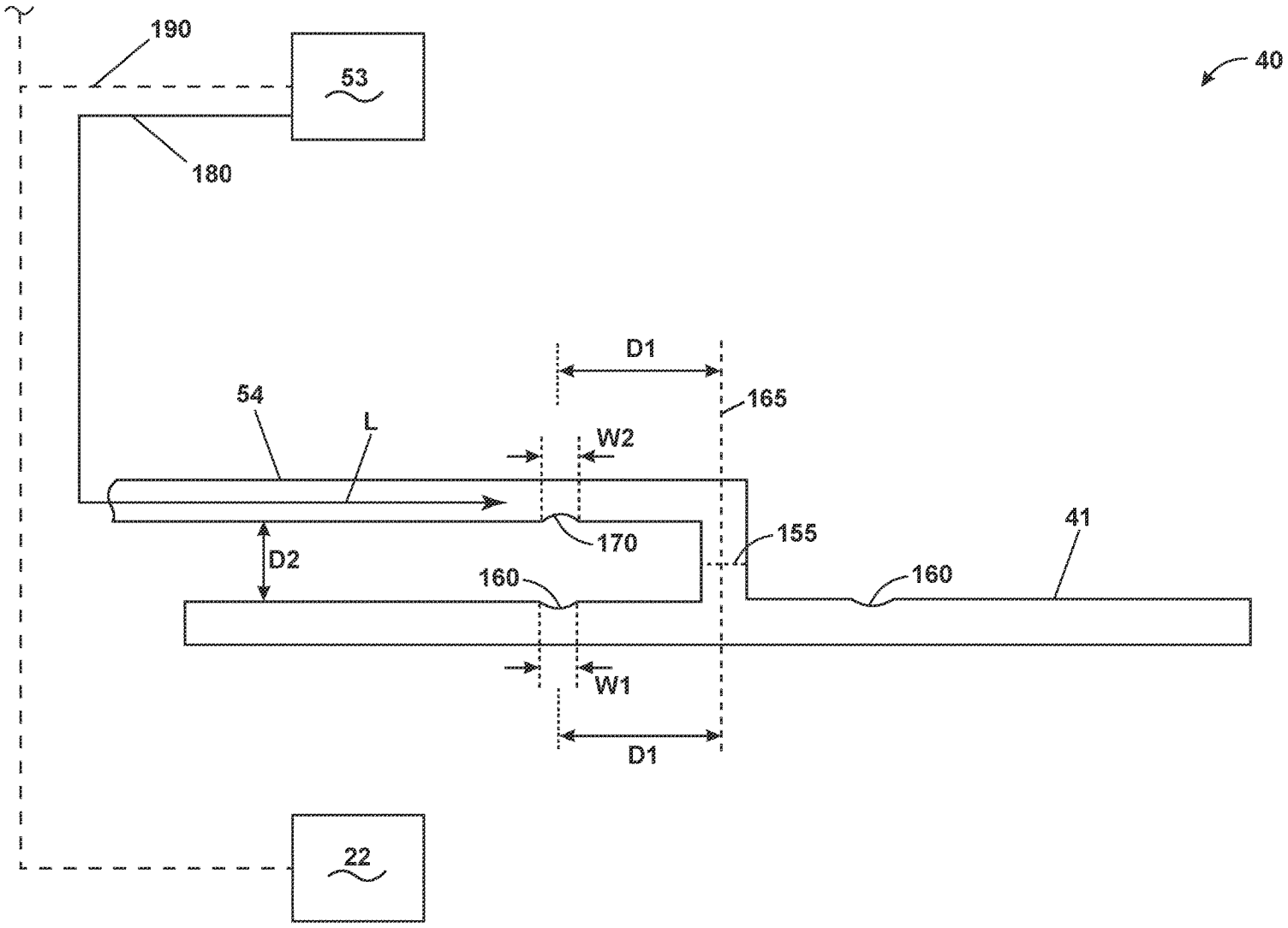
FIG. 4 is a schematic front view of a liquid supply conduit and rotatable spray arm in the dishwasher of FIG. 1 in accordance with various aspects described herein.

Turning to FIG. 4, one exemplary portion of the spray system 40 is shown within the treating chamber 16 (FIG. 2). The exemplary portion includes the liquid supply conduit 54 and upper spray arm 41 (hereafter "spray arm 41"), with it being understood that aspects of the disclosure can have general applicability to any of the liquid supply conduits 54-58 or any of the spray arms 41-45 (FIG. 2).

During the operation of a treating cycle, the liquid supply conduit 54 can be stationary within the treating chamber 16 and fluidly coupled to the rotatable spray arm 41. A portion of the liquid supply conduit 54 can be parallel to the spray arm 41 in some examples. The liquid supply conduit 54 is vertically spaced from the spray arm 41 in some examples. In addition, the spray arm 41 can rotate with respect to the liquid supply conduit 54. An exemplary rotational coupling 155 is illustrated between the spray arm 41 and liquid supply conduit 54. In some examples the rotational coupling 155 can include co-axial shafts, a bolt extending through an aperture, or the like. It will be understood that the rotational coupling 155 can be provided anywhere between the liquid supply conduit 54 and spray arm 41. In addition, while the rotational coupling 155 is shown at a midpoint of the spray arm 41, this need not be the case. In some examples, one end of the spray arm 41 can be rotationally coupled to the liquid supply conduit 54.

First apertures in the form of nozzle outlets 160 (hereafter "nozzle outlets 160") can be provided in the spray arm 41. In the example shown, the nozzle outlets 160 are provided on an upper surface of the spray arm 41 though this need not be the case. Any number of nozzle outlets 160 can be provided, including only one, or two or more. In some examples, the nozzle outlets 160 include non-identical outlets, such as non-identical outlet widths, outlet directions, outlet shapes, or the like, or combinations thereof.

At least one second aperture 170 (hereafter "aperture 170") can be provided in the liquid supply conduit 54. The aperture 170 is illustrated on a lower surface of the liquid supply conduit 54 though this need not be the case. The aperture 170 can confront the nozzle outlet 160 as shown.

The aperture 170 and nozzle outlet 160 can have any suitable size, shape, or the like. In the example shown, the nozzle outlet 160 defines an outlet width W1 and the aperture 170 defines an aperture width W2. The aperture width W2 can be the same size as the outlet width W1, or larger than the outlet width W1, or smaller than the outlet width W1. In some examples, the aperture 170 and nozzle outlet 160 can have the same or different geometric profiles.

The spray arm 41 can be rotatable about an axis 165 as shown. The aperture 170 and the nozzle outlet 160 can each be spaced from the axis 165 by a distance D1. In this manner, the aperture 170 and nozzle outlet 160 can have the same radial distance from the axis 165, such that the nozzle outlet 160 aligns with the aperture 170 once per revolution of the spray arm 41. In addition, a spacing distance D2 can be defined between the aperture 170 and nozzle outlet 160. The spacing distance D2 can be in a range between 1-20 cm in a non-limiting example.

It is also contemplated that multiple apertures 170 can be provided. For example, multiple apertures 170 can be directed toward a single nozzle outlet 160; multiple nozzle outlets 160 can be directed toward a single aperture 170; or multiple apertures 170 can be provided with each confronting a single corresponding nozzle outlet 160. Still further, multiple liquid supply conduits 54 can be provided with each having corresponding apertures 170.

A pump, such as the recirculation pump 53 (hereafter "pump 53"), can be fluidly coupled to the liquid supply conduit 54 as described above. An exemplary fluid coupling 180 is schematically illustrated in solid line between the pump 53 and the liquid supply conduit 54. It will be understood that the fluid coupling 180 can include a conduit, tube, or other mechanism allowing fluid flow at least from the pump 53 to the liquid supply conduit 54.

The controller 22 can be in signal communication with the pump 53. An exemplary signal coupling 190 is schematically illustrated in dashed line between the controller 22 and the pump 53. The signal coupling 190 can include any suitable interface providing for signal communication between the controller 22 and the pump 53, including a wired or wireless communication interface in some examples.

Figure 5:
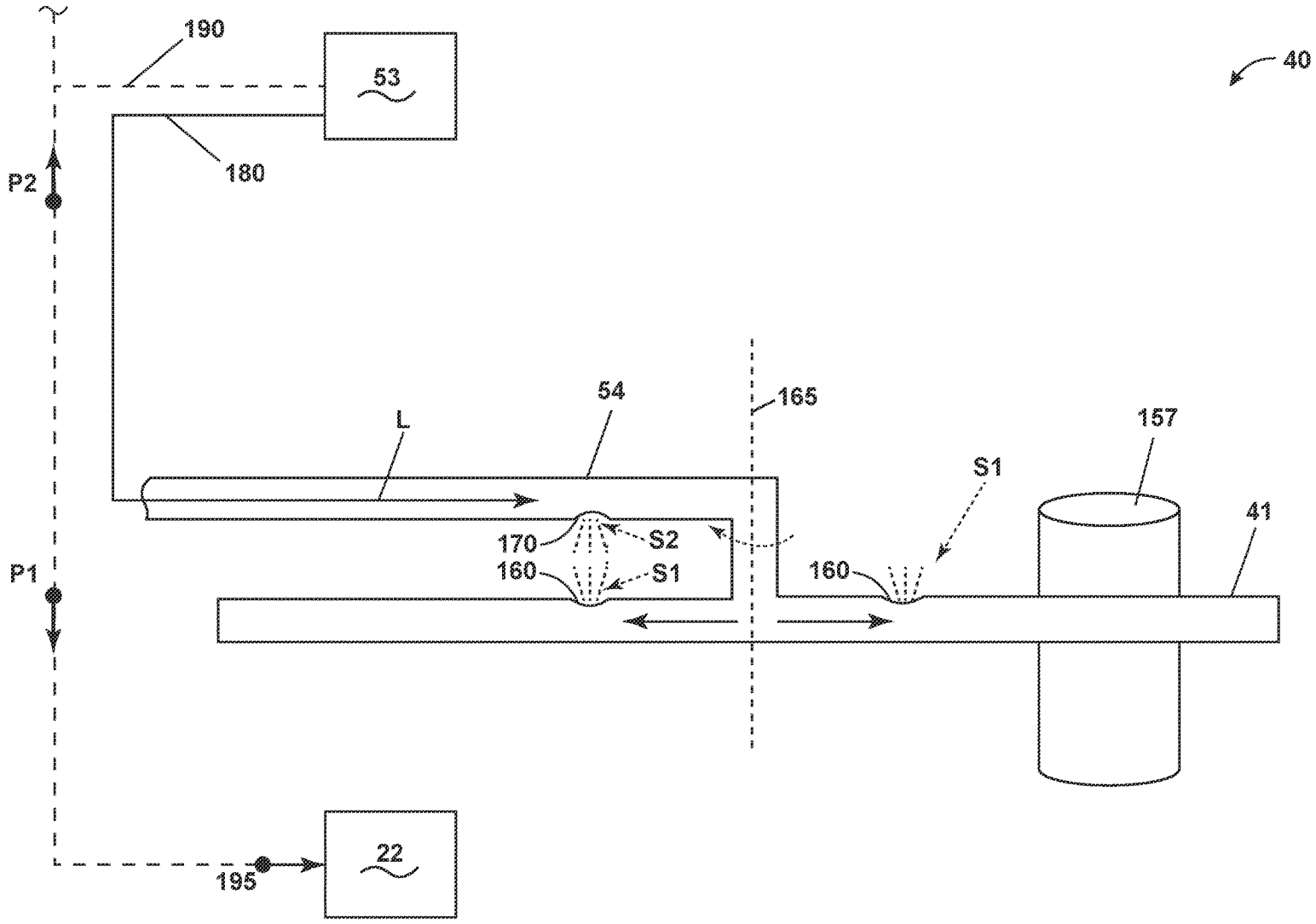
FIG. 5 is a schematic front view of the liquid supply conduit and rotatable spray arm of FIG. 4 during operation.

FIG. 5 illustrates the portion of the spray system 40 during a cycle of operation of the dishwasher 10 (FIG. 1). During operation, the pump 53 provides a flow of liquid (denoted "L") into the liquid supply conduit 54 and the spray arm 41. The nozzle outlets 160 can be oriented at an angle such that liquid L flowing through the nozzle outlets 160 can exert a torque on the spray arm 41, thereby causing rotation of the spray arm 41.

A portion of the liquid L can flow through the nozzle outlets 160 to form a first spray of the pumped liquid S1 (hereafter "first spray S1") as shown. Additional liquid L flowing through the aperture 170 can form corresponding second sprays of the pumped liquid S2 (hereafter "second spray S2") as shown. The first spray S1 can have a first flow rate, and the second spray S2 can have a second flow rate. In some examples, the first flow rate can be the same as the second flow rate. In some examples, the first flow rate can be less than the second flow rate. In some examples, either or both of the first flow rate or the second flow rate can be continuous.

The aperture 170 and nozzle outlet 160 can confront one another such that the second spray S2 can impinge the first spray S1 as the nozzle outlet 160 rotates past the aperture 170. In the illustrated example, the aperture 170 overlies the nozzle outlet 160 such that the first and second sprays S1, S2 are emitted vertically within the treating chamber 16 (FIG. 2) though this need not be the case. In another non-limiting example, the aperture 170 can confront the nozzle outlet 160 such that the first and second sprays S1, S2 are emitted horizontally. In still another example, the aperture 170 can confront the nozzle outlet 160 in such a way that the first and second sprays S1, S2 are emitted at an angle between horizontal and vertical.

Impingement of the first and second sprays S1, S2 can generate a state or a state change in the spray system 40, including the pump 53. Such a state or a state change can form a first signal P1 that can indicate a rotational state, e.g. rotation or non-rotation, of the spray arm 41. Some non-limiting examples include acoustic, fluid pressure, outlet spray direction, motor voltage, motor current, or the like, or changes therein, that can form the first signal P1.

In the non-limiting example shown, the impingement of the first and second sprays S1, S2 can cause a corresponding change in fluid pressure at the pump 53, which can form a time-variable pump motor voltage in the pump 53. The time-varying pump motor voltage can form the first signal P1 along the signal coupling 190. For example, impingement of the first and second sprays S1, S2 can form a back pressure in the liquid supply conduit 54, thereby causing an increase in pump motor voltage at the pump 53 to overcome the increase in pressure.

The controller 22 can receive the first signal P1 by way of the signal coupling 190. In one example when the spray arm 41 is in a rotating state, the first signal P1 can include a periodic signal corresponding to periodic impingement of the first spray S1 with the second spray S2. In another example, the spray arm 41 may be blocked, such as due to a tall dish item preventing rotation. It can be appreciated that the spray arm 41 may become blocked in a position where the first spray S1 impinges the second spray S2, or in a position where the first and second sprays S1, S2 do not impinge one another. Regardless of the position of the spray arm 41, the first signal P1 can be constant, or nearly constant, such as within 10% of a predetermined value. In this manner, the controller 22 can determine a rotational state of the spray arm 41 based on the first signal P1.

The controller 22 can also transmit a second signal P2 based on the determined rotational state of the spray arm 41. The second signal P2 can be provided to any suitable component of the dishwasher 10 including, but not limited to, the recirculation valve 59 (FIG. 3), the controllable valve 77 (FIG. 3), the wireless communication device 116 (FIG. 3), or the user interface 24 (FIG. 3).

Figure 6:
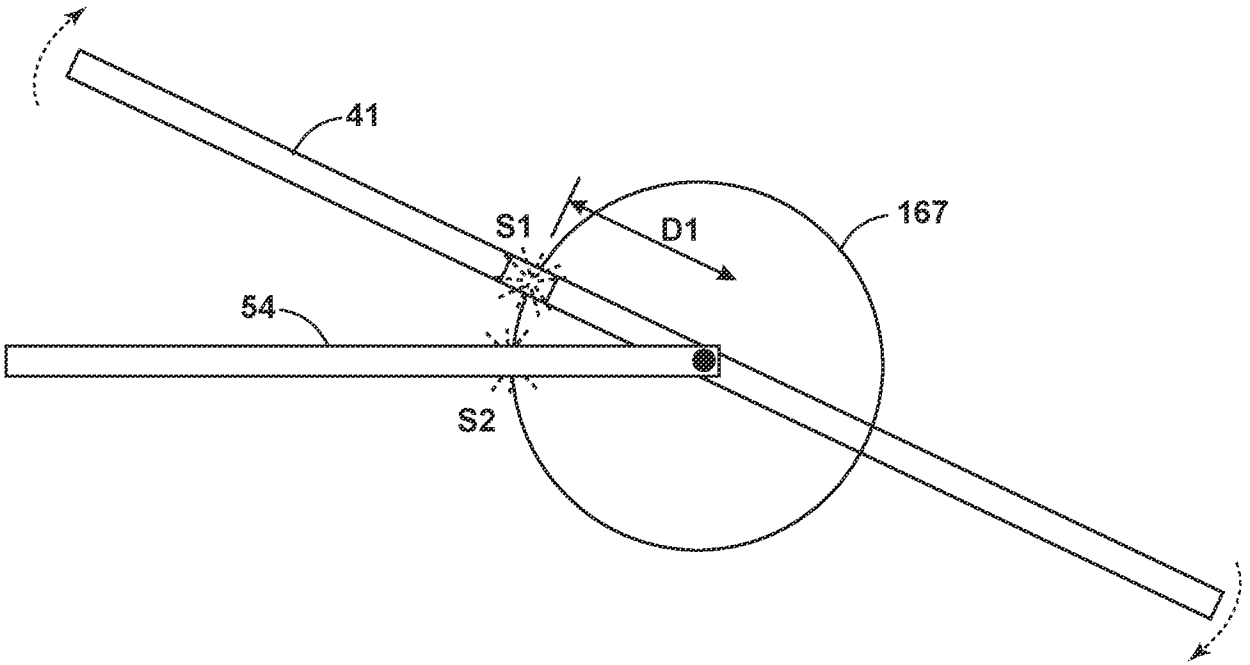
FIG. 6 is a schematic top view of the rotatable spray arm of FIG. 4 during operation.

FIG. 6 illustrates a top-down view of the spray arm 41 and nozzle outlet 160. During rotation of the spray arm 41, the first spray S1 emitted from the spray arm 41 can define a spray path 167 as shown. The second spray S2 from the liquid supply conduit 54 can be emitted into the spray path 167, including continuously emitted into the spray path 167, or at discrete time intervals, in some non-limiting examples. The second spray S2 periodically impinges the first spray S1, e.g. once per revolution of the first spray S1 along the spray path 167. In this manner, a rotational status of the rotatable spray arm 41 can be determined by sensing the first signal P1 (FIG. 5) corresponding to the impingement of the first and second sprays S1, S2 along the spray path 167.

Figure 7:
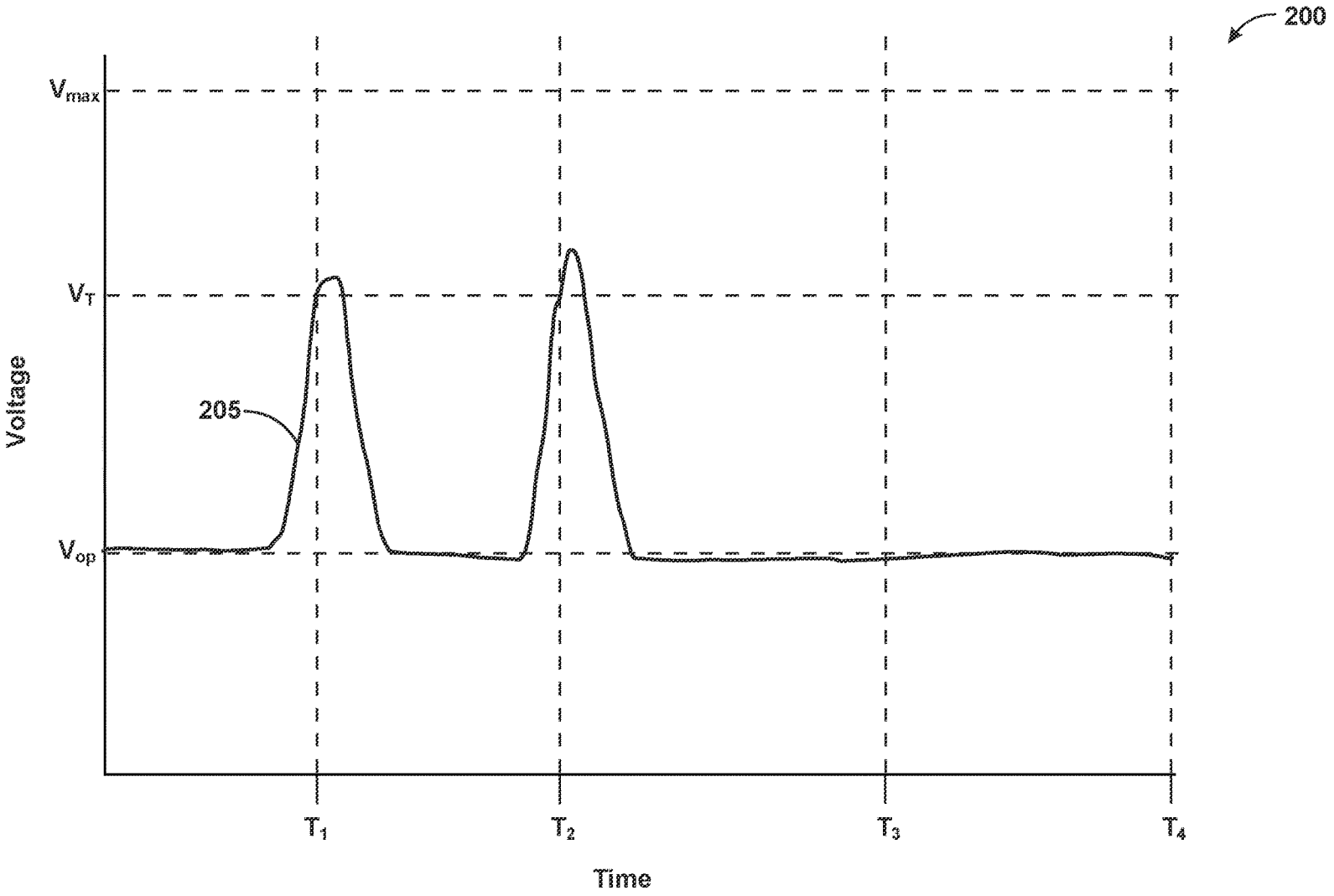
FIG. 7 is a plot illustrating a signal corresponding to rotation of the rotatable spray arm of FIG. 4.

Turning to FIG. 7, a plot 200 is shown for one exemplary implementation wherein a motor voltage 205 for the pump 53 forms the first signal P1 (FIG. 5). It will be understood that the exemplary implementation shown is but one example and does not limit the disclosure in any way. In another example, an electric current for the pump 53 can form the first signal P1 (FIG. 5).

In the example shown, the plot 200 includes a nominal operating voltage $V_{op}$ and a maximum voltage $V_{max}$ representing an operating range for the pump 53 motor voltage. The nominal operating voltage $V_{op}$ can be an average voltage with which the pump 53 operates during a cycle of operation, such as 12 V in one non-limiting example. The maximum voltage $V_{max}$ can represent a maximum possible motor voltage 205 of the pump 53 during operation, or a safety threshold value lower than the maximum possible voltage, in some non-limiting examples.

In addition, the plot 200 includes a voltage threshold $V_T$ representing a peak or threshold value corresponding to impingement of the first spray S1 and the second spray S2

(FIG. 5). For example, spray impingement can cause a back pressure in the liquid supply conduit 54 (FIG. 5), thereby causing the motor voltage 205 of the pump 53 to increase when pumping liquid.

A first time $T_1$ and a second time $T_2$ indicate two consecutive points where the motor voltage 205 increases from below the voltage threshold $V_T$ to above the voltage threshold $V_T$. A third time $T_3$ and a fourth time T4 indicate two points where the motor voltage 205 has a constant value. As used here, a "constant value" or "nearly a constant value" refers to a value that does not vary by more than a predetermined amount, such as within 10-20% in one example.

Referring generally to FIGS. 1-7, during operation of the dishwasher 10, the controller can receive the first signal P1 corresponding to any or all of the first time $T_1$, second time $T_2$, or voltage threshold $V_T$. In some non-limiting examples, the first signal P1 can include "pump motor voltage 205 has exceeded the voltage threshold $V_T$," "pump motor voltage 205 has varied by more than 70% within a time interval of 2 seconds," "pump motor voltage 205 has risen above voltage threshold $V_T$ twice within 5 seconds," "pump motor voltage 205 has not varied by more than 15% within 10 seconds," or the like.

The controller 22 can receive the first signal P1 and determine a rotational state of the rotatable spray arm 41. In the exemplary plot 200, the spray arm 41 is rotating prior to the third time $T_3$ and is blocked between the third time $T_3$ and fourth time $T_4$. In addition, in the illustrated example, the blocked spray arm 41 is in a position corresponding to non-impingement of the first and second sprays S1, S2, where the motor voltage 205 is at or near the nominal operating voltage $V_{op}$. It will be understood that the spray arm 41 can also be blocked in other positions corresponding to spray impingement. In such a case, the motor voltage 205 can have a constant or nearly constant value that is at or near the voltage threshold $V_T$, such as within 20% of the voltage threshold $V_T$ in one example.

In addition, referring generally to FIGS. 1-7, some exemplary implementations of the dishwasher 10 will be described below. It will be understood that the examples provided are for illustrative purposes and do not limit the disclosure in any way.

In one implementation, the controller 22 can provide the second signal P2 to the user interface 24 in the form of a user indication of the motion of the spray arm 41. The user indication can include, in non-limiting examples: an audio alert, e.g. a beep, a series of notes, or the like; a visual alert, e.g. a steady or blinking light, text message, icon, or the like; a display update, e.g. a menu bar, error message, or the like; or a notification on a mobile device, e.g. by way of the wireless communication device 116.

The controller 22 can also pause the cycle of operation when the first signal P1 indicates impeded rotation of the spray arm 41. In one implementation, the controller 22 can automatically pause the cycle of operation upon determination that the spray arm 41 is blocked or impeded from rotating. The controller 22 can also pause the cycle of operation, or proceed with the in-progress cycle of operation, based on other sensed wash cycle parameters. In one implementation, the controller 22 can determine a number of rotations of the spray arm 41 and automatically pause the cycle of rotation based on the number of rotations, e.g. "within 30 rotations of cycle start" in a non-limiting example. The controller 22 can also provide a notification to the user upon automatic pausing of the cycle, as described above.

In another implementation, the controller 22 can receive a user input 195 for handling a determined rotational state of the spray arm 41. The user input 195 can be provided by way of the user interface 24, or the wireless communication device 116, or the like. The user input 195 can be received prior to starting a cycle of operation, or during a cycle of operation, or upon completion of a cycle of operation. In one example, the user input 195 can include instructions to proceed with an in-progress cycle of operation when the signal P1 indicates that the spray arm 41 is blocked. In another example, the user input 195 can include instructions wherein, upon determining that the spray arm 41 is blocked, to only pause or proceed with an in-progress cycle of operation when a predetermined condition is met. Such a predetermined condition can include a predetermined time interval, such as "within five minutes of cycle end," or a predetermined cycle point, such as "prior to a drying cycle" or "after a wash cycle, and prior to a rinse cycle;" or a predetermined rotational value, such as "within 10 rotations of the wash arm after cycle start," or the like. In one implementation, the user input 195 can instruct the controller 22 to only pause the cycle of operation if the first signal P1 indicating spray arm 41 blockage is received within 20 rotations of the spray arm after starting the cycle. In another implementation, the user input 195 can be provided prior to starting a cycle, and instruct the controller 22 to proceed with an in-progress cycle of operation if the first signal P1 indicating spray arm 41 blockage is received during a rinse cycle. In still another implementation, the controller 22 can automatically pause the cycle of operation upon receiving the first signal P1 indicating spray arm 41 blockage and prompt for the user input 195, and a user can enter the user input 195 instructing the controller 22 to proceed with the cycle.

Figure 8:
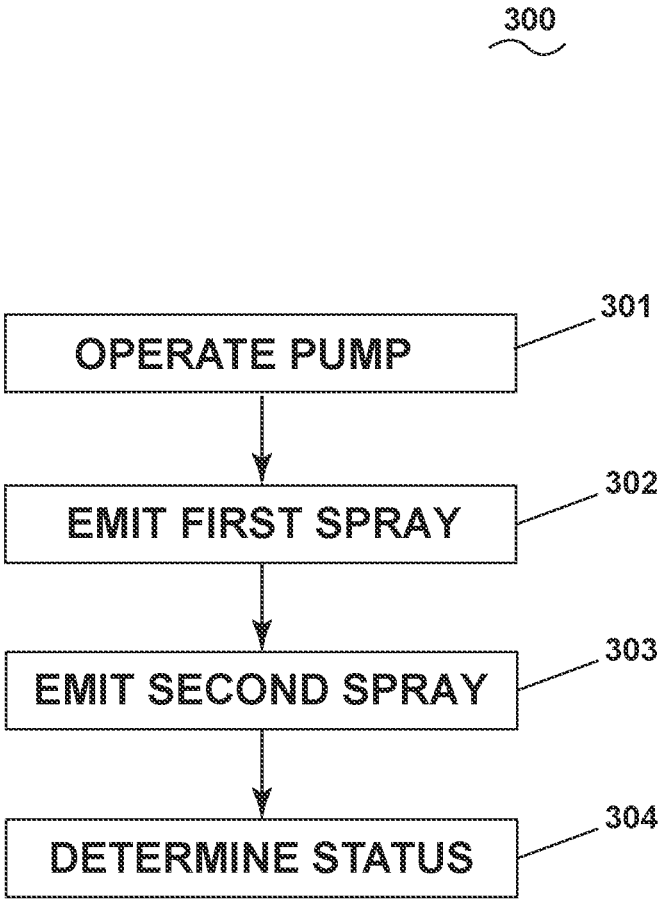
FIG. 8 illustrates a method of operating the dishwasher of FIG. 1.

Turning now to FIG. 8, aspects of the disclosure provide for a method 300 of operating a dishwasher according to a cycle of operation. The method 300 includes at 301 operating a pump, such as the pump 53, to supply liquid through a stationary supply conduit, such as the liquid supply conduit 54, to a rotatable spray arm, such as the spray arm 41. The method 300 includes at 302 emitting a first spray, such as the first spray S1, of the pumped liquid from a first aperture, such as the nozzle outlet 160, in the rotatable spray arm, with the first spray defining a spray path 167 as the spray arm rotates. The method 300 includes at 303 emitting a second spray, such as the second spray S2, of the pumped liquid from a second aperture, such as the aperture 170, in the stationary supply conduit into the spray path. The method 300 includes at 304 determining a rotational status of the rotatable spray arm by sensing a pump signal, such as the first signal P1, corresponding to the impingement of the first spray and the second spray along the spray path.

The method 300 can optionally include wherein impinging the first spray S1 with the second spray S2 is periodic with rotation of the spray arm 41. The method 300 can optionally include wherein the first signal P1 includes a time-varying pump motor voltage 205. The method 300 can optionally include providing a user indication of the rotational state of the spray arm 41, such as at least one of an audio alert, a visual alert, a display update, or a notification in a mobile device. The method 300 can optionally include automatically pausing the cycle of operation, via the controller 22, when the pump signal indicates impeded rotation of the spray arm 41.

Aspects of the disclosure provide for several benefits, including that spray arm rotation can be determined by way of existing dishwasher components without need of additional sensors. Generating small irregularities in water flow that can be detected when the spray arm is rotating, by way of the first jet through the supply conduit aperture, can provide for a readily detectable, periodic signal using the liquid supply and pump motor. Incorporation of user feedback, cycle elapsed time, and the like can provide for completion of a wash cycle in accordance with user preferences while still providing for improved cleaning performance.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

a rotatable spray arm having an outlet defining a rotational path as the rotatable spray arm is rotated;

a liquid supply conduit fluidly coupled to the rotatable spray arm, the liquid supply conduit comprising an aperture facing a portion of the rotational path;

a pump fluidly coupled to the liquid supply conduit and configured to supply liquid to the liquid supply conduit and the rotatable spray arm, wherein the pump is configured to provide a pump signal comprising at least one of a pump motor voltage and a pump motor current, and wherein the pump signal is indicative of an impingement between liquid emitted from the outlet and liquid emitted from the aperture; and a controller in signal communication with the pump, wherein the controller is configured to determine a rotational status of the rotatable spray arm based on the pump signal, the rotational status being whether or not rotation of the rotatable spray arm is impeded.

2. The dishwasher of claim 1, wherein liquid emitted from the outlet periodically impinges liquid emitted from the aperture to form a periodic change in at least one of the pump motor voltage and the pump motor current during rotation of the rotatable spray arm.

3. The dishwasher of claim 1, wherein the liquid supply conduit vertically overlies the rotatable spray arm within the treating chamber.

4. The dishwasher of claim 1, wherein the outlet is one of multiple nozzle outlets in the rotatable spray arm.

5. The dishwasher of claim 1, wherein the controller is further configured to automatically pause the cycle of operation when the pump signal indicates impeded rotation of the rotatable spray arm.

6. The dishwasher of claim 1, further comprising an user interface configured to receive an user input comprising one of continuing the cycle of operation or pausing the cycle of operation when the pump signal indicates impeded rotation of the rotatable spray arm.

7. The dishwasher of claim 6, wherein the user interface is configured to receive the user input prior to starting the cycle of operation.

8. The dishwasher of claim 1, wherein the impingement between liquid emitted from the outlet and liquid emitted from the aperture is periodic with rotation of the rotatable spray arm.

9. The dishwasher of claim 1, wherein the controller is configured to provide an user with an indication of the rotational status, the indication comprising at least one of an audio alert, a visual alert, a display update, and a notification on a mobile device.

10. The dishwasher of claim 1, wherein the liquid emitted from the outlet is a first spray comprising a first flow rate, and the liquid emitted from the aperture is a second spray comprising a second flow rate, wherein the first flow rate is less than the second flow rate.

11. The dishwasher of claim 1, wherein the liquid emitted from the aperture is continuously emitted into the rotational path.

* * * * *